United States Patent [19]

Hine, Jr.

[11] 4,129,013

[45] Dec. 12, 1978

[54] AIR-CONDITIONING UNIT WITH MULTI-POSITION COIL

[75] Inventor: Louis P. Hine, Jr., Norman, Okla.

[73] Assignee: Westinghouse Electric Corp., Pittsburgh, Pa.

[21] Appl. No.: 829,701

[22] Filed: Sep. 1, 1977

[51] Int. Cl.[2] ..... F25D 21/14; F25B 27/00; F28F 7/00; F28F 13/00

[52] U.S. Cl. ..... 62/285; 62/286; 62/291; 62/326; 165/76; 165/136

[58] Field of Search ..... 62/92, 93, 186, 285, 62/286, 288, 291, 298, 326, 371, 425, 515; 165/76, 137

[56] References Cited

U.S. PATENT DOCUMENTS

| | | | |
|---|---|---|---|
| 2,282,373 | 5/1942 | Minkler et al. | 165/122 |
| 2,822,674 | 2/1958 | Simmons | 62/285 |
| 3,000,193 | 9/1961 | Crider | 62/285 |
| 3,012,762 | 12/1961 | Norris | 165/48 |
| 3,089,315 | 5/1963 | Brandt | 62/326 |
| 3,174,541 | 3/1965 | Brandt et al. | 165/137 |
| 3,299,660 | 1/1967 | Sullivan | 62/285 |
| 3,596,475 | 8/1971 | Berger | 62/285 |
| 3,678,993 | 7/1972 | Pierce | 165/76 |
| 3,722,580 | 3/1973 | Braver | 62/263 |
| 3,882,690 | 5/1975 | Duell et al. | 62/288 |

*Primary Examiner*—Lloyd L. King
*Attorney, Agent, or Firm*—E. C. Arenz

[57] ABSTRACT

An air-conditioning unit with a blower section and an adjacent refrigerant evaporator coil section is adapted to be disposed for airflow through the unit in an upflow, counterflow, or horizontal flow direction by arranging the evaporator coil, and a drip pan separable from both the coil and the coil section, with the drip pan located in any of the four interior corners which extend from front to rear of the unit. The coil has a frame assembly with members at the ends of the fins of the evaporator coil provided with openings for passing condensate into the drain pan, the arrangement being such that either end of the coil may be received within the drain pan. The arrangement also includes the provision of means for supporting the coil from the drain pan in a pivotal engagement to accommodate the difference in angle at which the coil projects from the drain pan in accordance with whether the positioning of the unit is vertical or horizontal.

8 Claims, 12 Drawing Figures

AIR-CONDITIONING UNIT WITH MULTI-POSITION COIL

BACKGROUND OF THE INVENTION

1. Field of the Invention

The invention pertains to air-conditioning unit constructions and in particular to constructions involving coil dispositions to accommodate different positionings of the unit.

2. Description of the Prior Art

The general type of air-conditioning unit with which this invention is mainly concerned is sometimes called an air handler in the art, and basically includes a cabinet having a refrigerant evaporator coil in what is called the coil section, and a blower in the adjacent blower section. Such units are ordinarily used in what is called a split system where the refrigerant compressor and condenser are housed in a separate remote unit. These air handlers are also frequently designed to have an electrical resistance heating unit either installed in the cabinet or added to the cabinet as a module.

Depending upon the particular building construction in which the unit is to be installed, it is desirable that a given unit be adaptable to installation in either a vertical disposition or a horizontal disposition. Further, in the vertical disposition the application may be for either upflow, in which the air passes upwardly through the unit, or in downflow in which the air passes down through the unit. Also, in all of these vertical dispositions it is desirable that the air inlet location be available not only from the end of the unit, but also from either the right- or left-hand sides of the coil section. In the horizontal disposition, it is desirable that the air inlet locations be available for either right-hand airflow or left-hand airflow.

It is of course possible for the manufacturer of the units to make a different model to accommodate each of the particular installations. However, this would present problems to the industry in that the manufacturer first has to make all of the different models, and the distributor must stock a sufficient number of each type to satisfy the demand, which may not be uniform across the model line.

This problem has of course been recognized in the air-conditioning field, and air-conditioning units adapted for different dispositions have been disclosed and are in commercial use.

For example: U.S. Pat. No. 3,089,315 discloses an air-conditioning unit which includes an arrangement in which the evaporator coil may be removed and reinstalled in a different orientation to accommodate either an upflow or a downflow installation, but this unit is relatively limited with respect to flexibility beyond such installations.

Examples of other patents having arrangements directed to the solution of some of the same problems to which this invention is directed include U.S. Pat. Nos. 3,299,660; 3,596,475 and 3,678,993.

However, in none of these arrangements is there the total flexibility available with an arrangement according to my invention and in which a single basic unit can be adapted for all of the types of installation.

SUMMARY OF THE INVENTION

In accordance with the invention, the air-conditioning unit is adapted for the multi-position installation by providing a refrigerant evaporator coil and a separable drain pan, the drain pan being adapted for positioning in any of the four interior corners of the coil section which extend from front to rear, and with either of the ends of the coil being adapted to be received by the drain pan and pivotally supported therefrom. In the horizontal disposition of the unit, an auxiliary, extended-area drip pan is available to ensure that any condensate which might drop from the face of the coil will be directed into the drain pan in the corner of the coil section.

DRAWING DESCRIPTION

Figure 12:
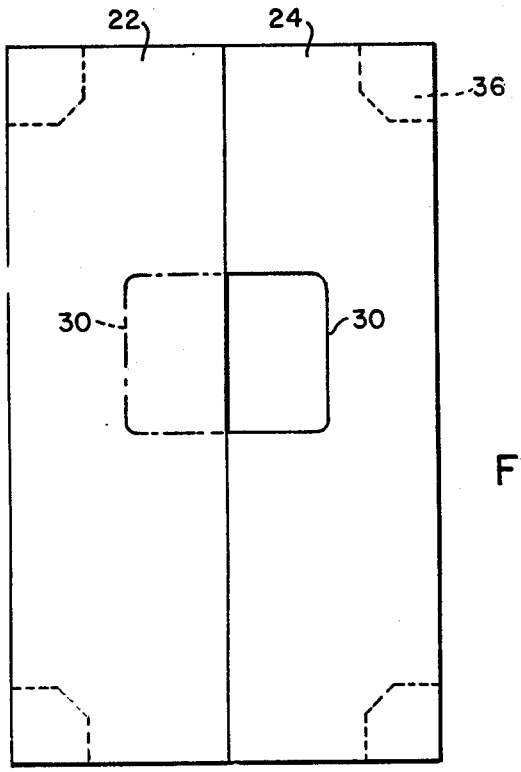
Figure 10:
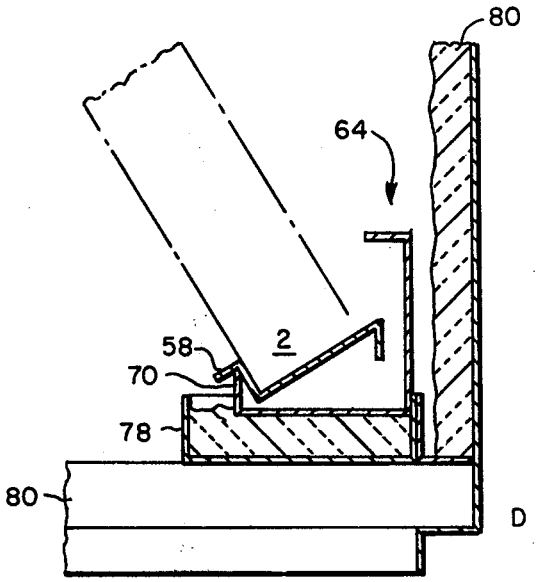
Figure 11:
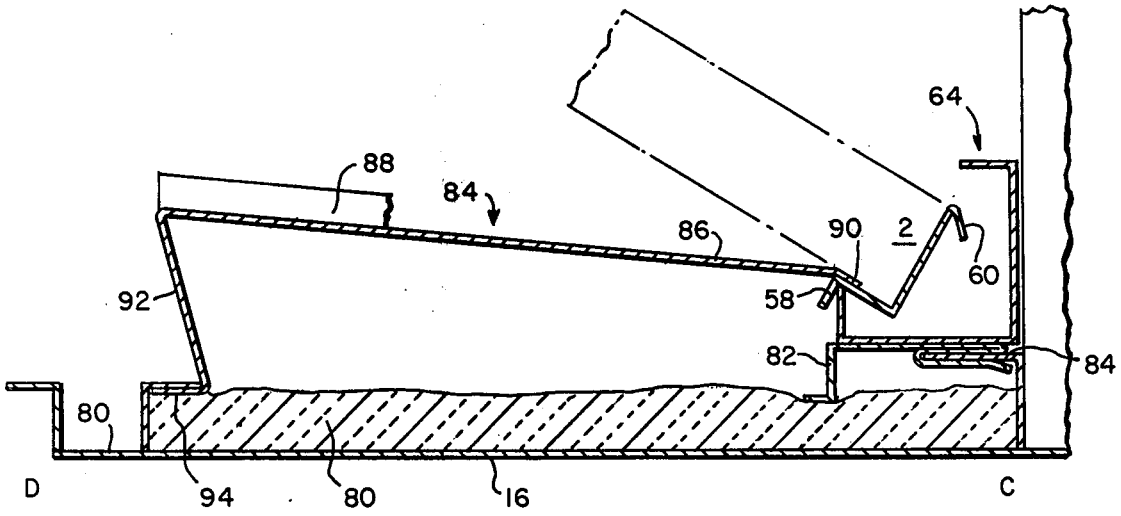

FIGS. 4 through 9, inclusive, are somewhat schematic front-face views of a unit illustrating the various dispositions of the coil and drain pan in the various positions of the unit;

FIG. 10 is a fragmentary partly schematic view of the coil and drain pan as located in the cabinet for one of the vertical dispositions of the unit;

FIG. 11 is a partly schematic view showing the arrangement for a horizontal disposition of the air-conditioning unit; and FIG. 12 is a front view of the access panel arrangement.

DESCRIPTION OF THE PREFERRED EMBODIMENT

Figure 1:
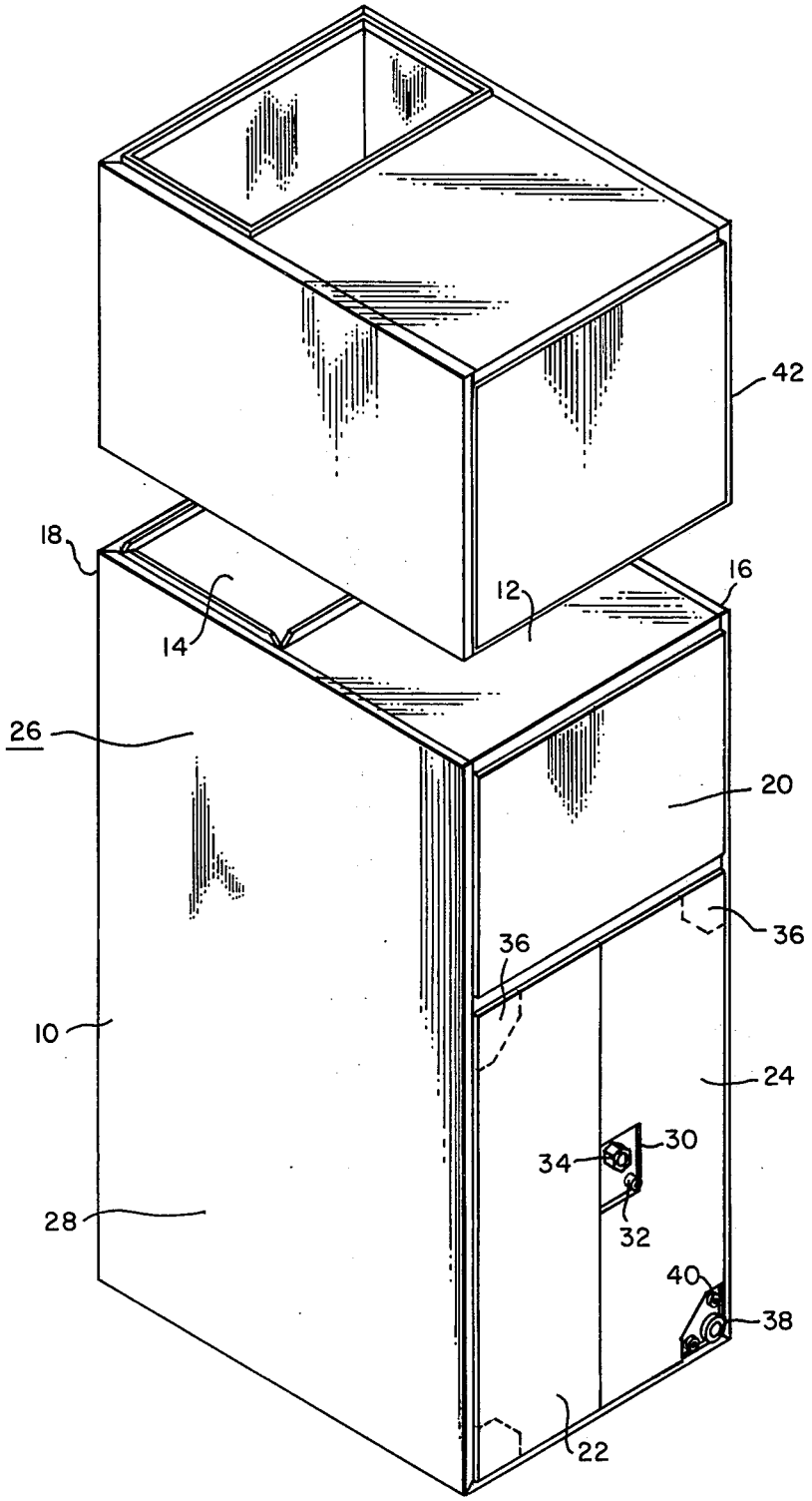
FIG. 1 is an isometric view of an air-conditioning unit according to the invention.

Referring to FIG. 1, the cabinet shell includes left wall 10, top wall 12 with an air outlet 14, right wall 16, rear wall 18 and front wall which includes an upper blower access panel 20 and the two lower access panels 22 and 24. The interior of the cabinet is divided into an upper blower section 26 behind the upper panel 20 and the lower coil section 28 behind the coil access panels.

One of the lower access panels 24 has a cutout 30 to accommodate the forward projection of the refrigerant pressure and suction line connections 32 and 34, respectively. The two access panels fit together along the vertical line with a slip joint (not shown). At each corner of the access panel assembly a knockout 36 is provided, with the one in the lower right corner having been removed to accommodate the projecting drain and overflow connections 38 and 40, respectively, which project from the end of the drain pan as is better seen in FIG. 3.

FIG. 1 also shows an electric resistance heating module 42 in exploded relation to the main cabinet and adapted to be secured to the end of the cabinet if the installation requires electric heat. The unit shown in FIG. 1 is in its upflow disposition in which, if electric heat were required, the module 42 would sit on the top of the cabinet. If the main unit in FIG. 1 were inverted for a downflow or counterflow installation, then the module would be at the bottom of the unit, because of the inversion of the basic cabinet.

Figure 2:
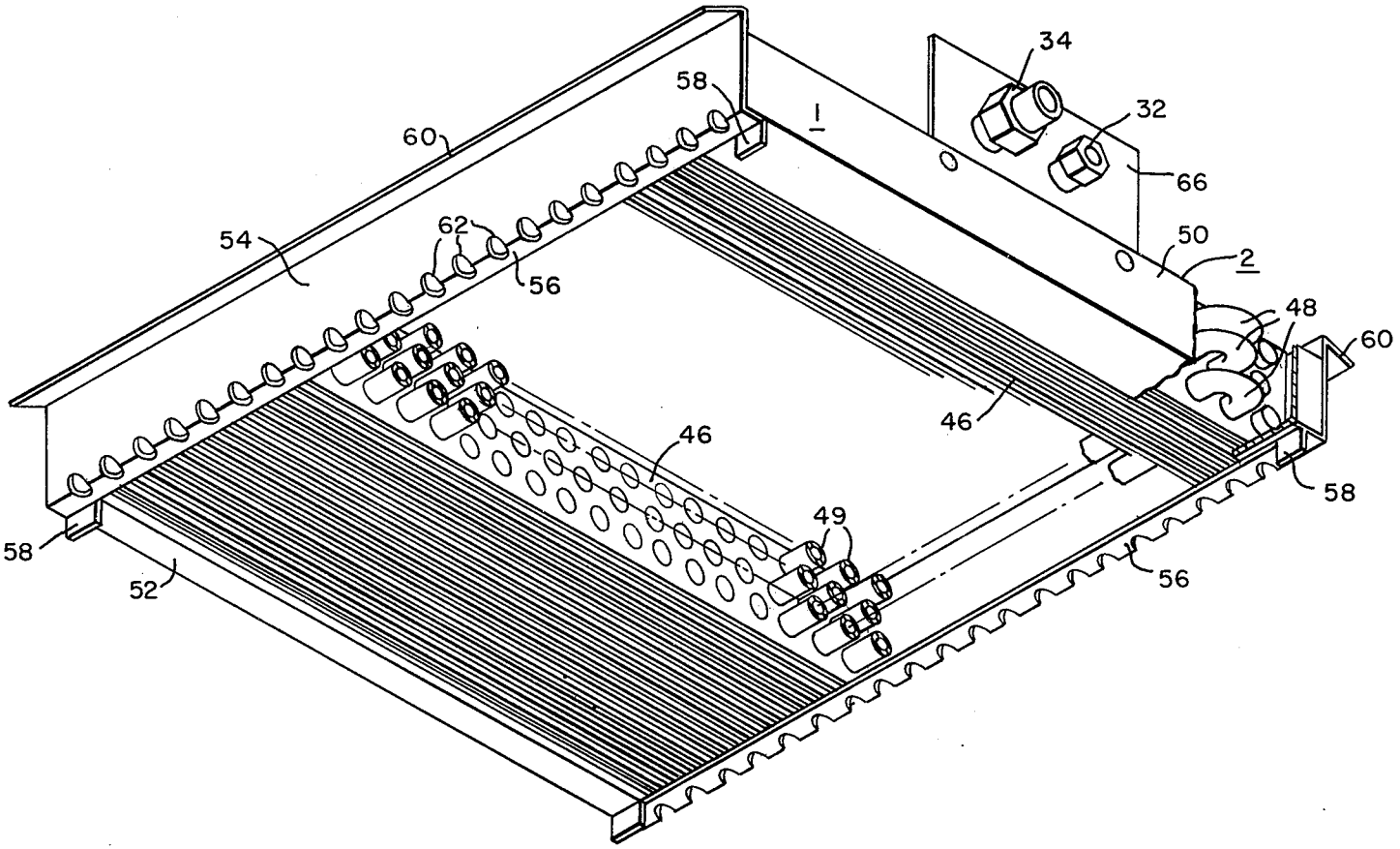
FIG. 2 is a broken isometric view of the coil and frame assembly according to the invention.

Referring to FIG. 2, this view is looking at the lower face of the refrigerant evaporator coil generally designated 44 and the frame assembly which basically encompasses the perimeter of the coil. The coil is of conventional fin and tube construction in which the fins are identified by numeral 46 and return bends 48, for the tubes are shown in the broken-away portion of the return bend protector member 50. The coil is basically rectangular in outline and accordingly the coil frame assembly which encompasses the periphery of the coil is also rectangular in outline. Besides the return bend protector member 50, which is basically L-shaped in cross section, a similarly L-shaped hairpin end protector member 52 is provided at the back side edge of the coil. The members of the frame assembly at the opposite ends of the coil include a main portion of generally L-shaped including the plate end portion 54 at the end edges of the fins, the right flange portion 56, a right angle tab 58 bent down at the edge of flange 56 at both the front and rear of the coil, and a flange 60 extending for the length of the plate at the edge of the drain trough opposite the tabs 58. The plates 54 and flanges 56 together form an intermediate drain trough at both of the opposite ends of the coil. Their shape is the same but they are arranged in mirror relation in the assembled form of the frame. In the corner of the L-shaped part of the drain trough, a series of openings 62 are provided to permit the condensate which collects in the drain trough to pass into the drain pan 64 (FIG. 3) in which the drain trough is received. The return bend protector member 50 at the front side of the coil also has a connector support plate 66 attached to it, this plate securing the pressure and suction connectors 32 and 34.

It is noted that in a conventional type of construction of the coil which may be used in the invention, the pressure connector 32 is connected to a manifold to which a number of capillary tubes are connected, these capillary tubes then passing to connections at the ends of the tubes 49 of the coil proper. Similarly, the refrigerant gas to be passed from the evaporator coil back to the compressor (not shown) may be collected in several lines which in turn are connected to a suction manifold member which is in communication with the suction outlet 34. This type of arrangement described is conventional in the art, and to the extent that the capillary tubes must be of a length which requires that they be arrayed on one of the two faces of the coil, they be arrayed on the face opposite that seen in FIG. 2, which is the face which will always be facing upwardly in any disposition of the air-conditioning unit, as will become more apparent in connection with the description of FIGS. 4–9.

Figure 3:
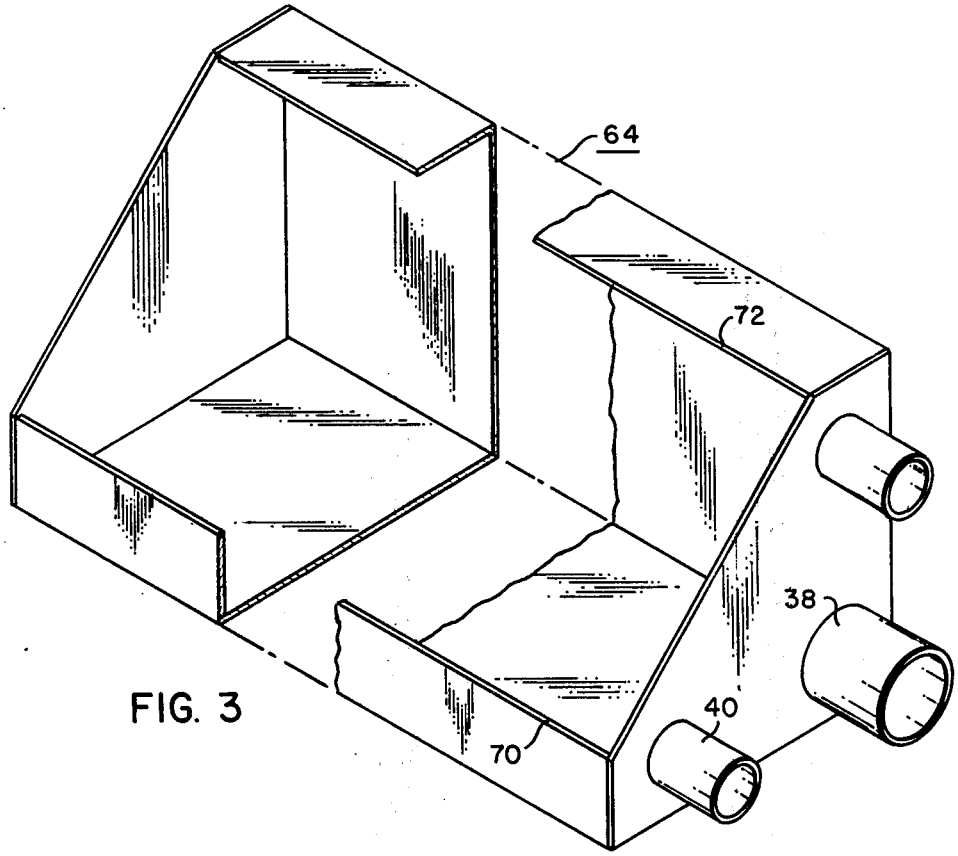
FIG. 3 is a broken isometric view of a drain pan which cooperates with the coil.

Referring to FIG. 3, the drain pan 64 has a shape in transverse cross section of a square, with one corner truncated to provide a diagonally open face 68 into which a drain trough of one or the other opposite ends of the coil is to be received. Thus, depending upon which particular interior corner of the coil section has the drain pan 64 installed, either the lip 70 or 72 will be engaged by the corner formed between a tab 58 and the toe 56 of one or the other drain troughs. The ends of the drain pan are of course closed with the end 74 to which the drain and overflow connections are made always being located at the front side of the unit.

Referring now to FIGS. 4 through 9, these figures have letters A through D at the corners of the coil section 28, each letter indicating a particular interior corner of the coil section which extends in a front-to-rear direction, regardless of the upright, inverted, or horizontal position of the unit. These figures also indicate the location of the blower 75 in the blower section 26 and the direction of airflow through the unit. The representations of the coil each has the numeral 1 at one end and 2 at the opposite end to aid in the explanation of the various dispositions of the coil relaive to the drain pan in its various locations within the coil section.

Figure 4:
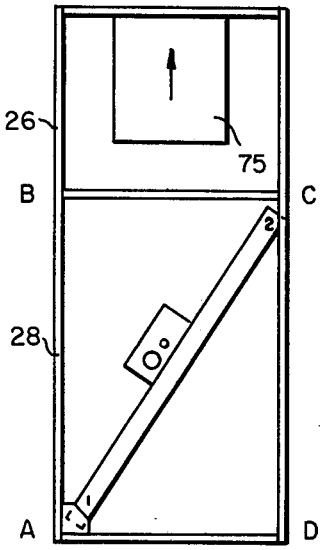
Figure 5:
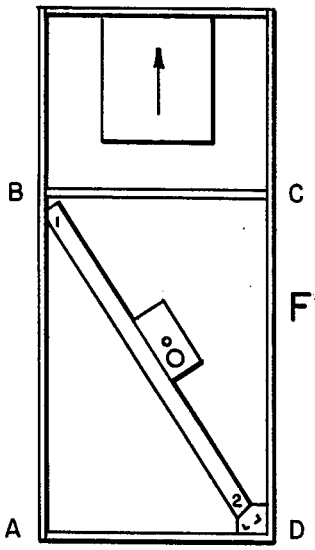
Figure 6:
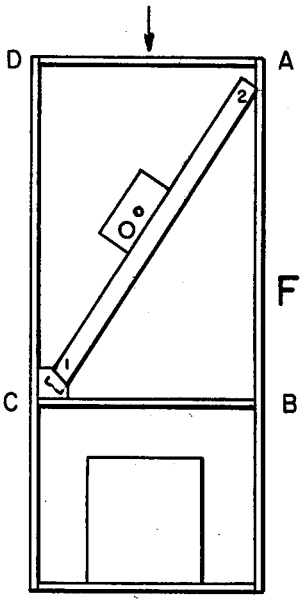
Figure 7:
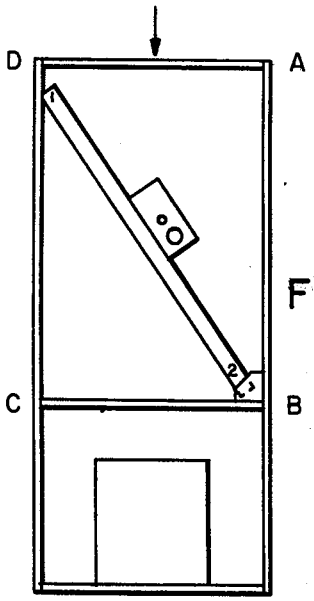
Figure 8:
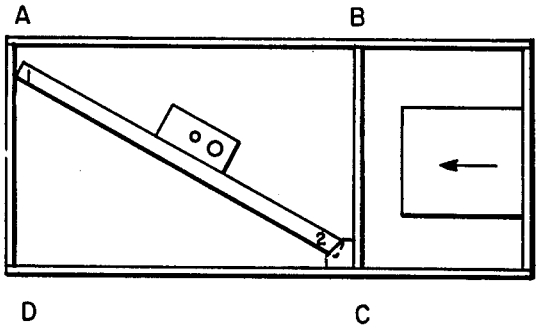
Figure 9:
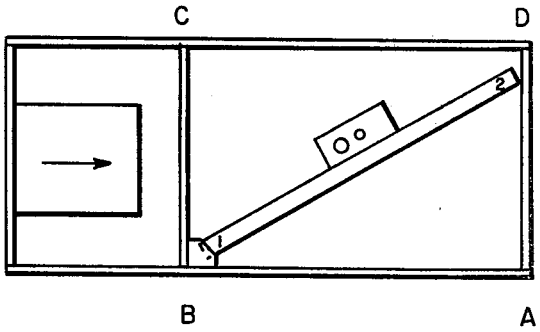

In FIGS. 4 and 5 the unit is arranged for the air to flow upwardly through either the bottom in both cases, or through a right-hand inlet in FIG. 4 or a left-hand inlet in FIG. 5. These right- and left-hand inlets are provided by opening a part of the side wall of the coil section and closing the bottom inlet for a particular installation. In the downflow positioning of the unit as shown in FIGS. 6 and 7, the air flows into either the top end (corresponding to the bottom end of FIGS. 4 and 5), or through the left-hand side in FIG. 6, or the right-hand side in FIG. 7 according to the particular installation. In FIGS. 8 and 9 in the horizontal positioning of the unit, the flow is from left to right through the unit in FIG. 8, or from right to left in FIG. 9. It is noted that in FIGS. 8 and 9 a drip pan 76 is provided, the installation of which will be explained in more detail in connection with FIG. 11. Because of the presence of the drip pan, airflow into the coil section in an upward direction in the horizontal positioning is obstructed ordinarily. However, if the volume of air for a particular unit would be great enough that its velocity would be adequate to ensure that condensate did not drop off the fins because of the upward force of the air on the condensate, then the drain pan could be omitted and an upflow introduction of air permitted.

By examining the six arrangements shown in FIGS. 4 through 9, it will be seen that the coil extends diagonally between each two of the opposite sets of front-to-rear-extending interior corners in the coil section, with each of the opposite ends of the coil being located in each of the four corners in at least one positioning of the unit. Thus, it will be seen that the coil end 1 is in the A corner in FIGS. 4 and 8, in the B corner in FIGS. 5 and 9, in the C corner in FIG. 6, and in the D corner in FIG. 7. The opposite end 2 of the coil will obviously be in the opposite corner in those figures. The drain pan 64 is also located in each of the four corners in at least one of the positions of the unit. Thus, it will be seen that the drain pan is in the A corner in FIG. 4, is in the B corner in FIGS. 7, 8 and 9, is in the C corner in FIG. 6, and is in the D corner in FIG. 5.

It is to be particularly noted that the face of the coil which is free of any array of cap tubes and connecting lines always faces downwardly regardless of the positioning of the unit and the direction of airflow. This arrangement is advantageous is that any condensate which might form on cap tubes and connecting lines at the upper face of the coil can drop onto the fins and follow the fins down to the drain pan. This arrangement of always having the one surface of the coil facing downwardly also permits refrigerant circuiting arrangements which can promote heat transfer from the refrigerant to the air.

Referring to FIG. 10, the general relationship of the way in which the end 2 of the coil fits in the drain pan 64 in the positioning of the unit as in FIG. 5 is shown. A thermally insulated channel-shaped pan 78 is seated on the cabinet base frame 80 in the interior corner D of the coil section. The coil and drain pan 64 are put together outside of the coil section by simply placing the coil end 2 into the diagonally open face of the drain pan with the corner formed by the tab 58 and the toe 56 of the drain trough engaging the edge of the lip 70 of the drain trough in a pivotal relation. The drain pan and coil are then moved as a unit into the open rectangular face of the coil section, the pivotal relation of the coil and drain pan permitting manipulation to clear the extreme corners of the parts for the entry into the coil section. The drain pan 64 is then seated on the insulated pan 78 and the upper end of the coil is permitted to pivot downwardly until that corner of the drain trough assembly which has the condensate openings at the number 1 end of the coil rests against the thermal insulation 80 on the inside face of the left wall 10 of the unit. This thermal insulation 80 is provided on the interior face of all of the walls of the coil section. The drain pan 78 is used for the installation in all of the vertical positions of the unit.

In FIG. 11, the arrangement for a horizontal positioning of the unit is shown, this particular figure corresponding to the unit positioning shown in FIG. 8. In this particular case, a drain pan support member 82 shaped in cross section as shown in FIG. 11 and having its length extending from the front to the rear of the unit in the C corner is slip-fitted onto a flange 84 of the cabinet frame assembly to prevent tilting of the drain pan 64 in its installed position. Again, the coil and drain pan 64 are assembled outside the unit and slipped into the open rectangle in the same general way as was described in connection with FIG. 10. However, in the case of the horizontal positioning of the unit, the upper end 1 of the coil is permitted to pivot down to engage the cabinet base frame 80 rather than a side wall of the coil section. As a result, the diagonal disposition of the coil within the coil section differs between a vertical positioning of the unit and a horizontal positioning of the unit. It will also be noted from a comparison of FIGS. 10 and 11 that the flange 60 is deeper within the drain pan 64 in the vertical positioning of the unit relative to the horizontal positioning of the unit. However, the difference in the angular dispositions of the coil within the coil section is not as great as would at first glance appear from the relation of the flange 60 within the drain pan since the lip of the drain pan 64 with which the coil engages in any of the vertical modes is closer to an end of the coil section than in the case of the horizontal positioning of the unit. In other words, in any vertical positioning of the unit the end of the coil appears to seat more deeply in the drain pan than in the horizontal positioning of the unit.

The drip pan generally designated 84 in FIG. 11 is usually used whenever the unit is installed horizontally. It includes a main flat portion 86 with upwardly directed flanges 88 along both edges, a slightly angled flange 90 of slightly less length than the distance between the two support tabs 58 at any one end of the coil, opposite end leg 92 of sufficient height to provide for the drain slope of the drip pan, and a stub flange 94 along its lower edge. To install the drip pan 84 after the drain pan and coil have been placed in the coil section, the leg 92 is flexed toward the flat portion 86 so that the stub flange 94 can be placed below the flange on the base frame 80.

Referring to FIG. 12, the two access panels 22 and 24 are shown in the same way as in FIG. 1 with the cutout 30 in solid lines being located to the right of the vertical joint and accommodating the projecting fittings of the coil when the unit is positioned as in FIGS. 5, 6 and 9. If the unit is to be positioned as in FIGS. 4, 7 and 8, the two panels are turned end for end as a unit to locate the cutout to the left as indicated by the dash lines. Thus, the two panels accommodate the protrusion of the connecting fittings in all of the positions of the unit.

Referring to FIG. 1, preferably the knockouts 36 in the access panels are dimensioned so that the edge which faces the overflow tubes 40 will bear against the overflow tubes in the installed position of the access panel means. This promotes holding the parts in place during shipping.

To provide a reasonable air seal at the cutout 30 (FIG. 12), an adequately sized sheet of gasket material is interposed between the connection support plate 66 and the interior face of the access panels.

The arrangement as described permits a standard air-conditioning unit to be shipped to the distributor with the coil and drain pan in position in the unit in a disposition such as in FIG. 4, for example. Additionally, a kit including drip pan 84 and the drain pan support 82 is provided, these two elements being adequate to convert from any vertical position to a horizontal positioning of the unit.

While the dimensions of the coil section of the type air-handler described typically has a narrower width than height of the coil section so that a cross section in the plane of the front will typically be in the form of a rectangular having unequal length sides as distinguished from a square, the principles of the invention are applicable to a unit in which the cross section is that of a square.

What is claimed is:

1. An air-conditioning unit comprising:

a cabinet including adjacent blower and coil sections, said coil section being of regular hexahedron shape and having access panel means for the front side of said coil section;

a refrigerant evaporator coil of rectangular outline and of fin and tube construction having a pair of opposite ends at the opposite ends of the fins;

coil frame means including means at both of said opposite ends to permit the drainage of condensate therefrom at a location generally in the plane of the face of the coil which always faces downwardly;

a drain pan freely separable from the cabinet and the coil, and having a diagonally open face to receive whichever opposite end of the coil is lower in any of the diagonal dispositions of the coil in the section;

said coil frame means including means to engage said drain pan at both of said opposite ends of said coil and with said condensate drainage means within the pan; and means in said cabinet for supporting said drain pan in any of the four front-to-rear extending corners with the coil extending diagonally to an opposite corner, so that said cabinet may be disposed for airflow therethrough in upflow and downflow directions with right- and left-hand air entry options, and in either direction horizontal airflow.

2. In the unit according to claim 1, wherein:

said drain pan has a shape in transverse cross section of a square with a truncated corner with said diagonally open face being symmetrically disposed; and said engaging means of said frame means engages said drain pan in a fashion permitting pivoting of said coil relative to said drain pan for obtaining different diagonal dispositions of said coil in said coil section.

3. In the unit according to claim 1, wherein:

said evaporator coil includes refrigerant suction and discharge connections for said coil and refrigerant line means connecting said connections to said coil, said refrigerant suction and discharge connections being at the face of the coil which always faces upwardly.

4. In the unit according to claim 3, wherein:

said access panel means includes means defining a cutout portion located in said panel in a position to accommodate the projection of said refrigerant connections by installing said access panel means one way or turning said panel means end for end, regardless of the location of said drain pan means and the diagonal disposition of said coil.

5. In the unit according to claim 4, wherein:

said drain pan means includes a drain outlet and first and second overflow outlets projecting out of one end of said drain pan; and said access panel means includes a knockout at each of its four corners to accommodate said projections.

6. A unit according to claim 5, wherein:

said overflow tubes are equidistant from the corner of said drain pan; and said knockouts are dimensioned so that an edge of said knockout bears against said overflow tubes in the installed position of said axis panel means.

7. An air-conditioning unit construction comprising:

cubically shaped cabinet means forming an airflow passage adapted to contain a refrigerant evaporator coil therein in either of two diagonal dispositions, and a unidirectional flow blower means at one end of said airflow passage;

a rectangular refrigerant evaporator coil of fin and tube construction having one pair of opposite end edges at the ends of said fins;

frame means at each of said opposite end edges to substantially block airflow through said end edges and to receive condensate passing down said fins to whichever end edge is lower;

a drain pan having an open face portion presented diagonally to the interior of said cabinet means with said pan located in any of the four interior corner areas bounding the said two diagonal disposition locations;

one of said end edges of said coil being received in said drain pan and being supported therefrom in a disposition to pass condensate received by said end frame means into said drain pan;

said drain pan being freely separable from said cabinet and said coil to accommodate its installation in said cabinet in any of said four interior corner areas with one or the other of said end edges being received therein so that said cabinet may be disposed for airflow therethrough in an upflow, counterflow, or horizontal flow direction.

8. In a unit according to claim 7, wherein:

said evaporator coil includes refrigerant suction and refrigerant discharge connections for said coil and refrigerant line means connecting said connections to said coil, said connections being located close to one face of said coil;

said frame means having the means to receive condensate being located adjacent to the plane of the other face of said coil, said other face of the coil facing downwardly in all dispositions of said coil.

* * * * *